US008667869B2

(12) United States Patent
Ge

(10) Patent No.: US 8,667,869 B2
(45) Date of Patent: Mar. 11, 2014

(54) SPINNER ASSEMBLY FOR OILFIELD TUBULAR CONNECTIONS

(76) Inventor: Yaogen Ge, Katy, TX (US)

( * ) Notice: Subject to any disclaimer, the term of this patent is extended or adjusted under 35 U.S.C. 154(b) by 1538 days.

(21) Appl. No.: 11/120,720

(22) Filed: May 3, 2005

(65) Prior Publication Data

US 2006/0248984 A1 Nov. 9, 2006

(51) Int. Cl.
*B25B 17/00* (2006.01)
*B25B 13/50* (2006.01)

(52) U.S. Cl.
USPC ..... 81/57.15; 81/57.33

(58) Field of Classification Search
USPC ..... 81/57.15–57.17, 57.2, 57.22, 57.34; 166/77.51, 78.1, 85.1; 279/62; 74/439, 74/450
See application file for complete search history.

(56) References Cited

U.S. PATENT DOCUMENTS

| | | | | | |
|---|---|---|---|---|---|
| 3,521,509 | A | * | 7/1970 | Hunter et al. | 81/57.15 |
| 3,799,009 | A | | 3/1974 | Guier | |
| 4,005,621 | A | | 2/1977 | Turner, Jr. et al. | |
| 4,446,761 | A | | 5/1984 | Boyadjieff et al. | |
| 4,774,861 | A | * | 10/1988 | Hamilton et al. | 81/57.33 |
| 5,000,065 | A | | 3/1991 | Haynes | |
| 5,054,550 | A | | 10/1991 | Hodge | |
| 5,660,087 | A | * | 8/1997 | Rae | 81/57.2 |
| 5,785,132 | A | * | 7/1998 | Richardson et al. | 175/57 |
| 5,791,206 | A | | 8/1998 | Daigle et al. | |
| 6,206,096 | B1 | | 3/2001 | Belik | |
| 6,253,845 | B1 | * | 7/2001 | Belik | 166/77.51 |
| 6,276,238 | B1 | * | 8/2001 | Junck et al. | 81/57.34 |
| 6,510,762 | B1 | * | 1/2003 | Beier et al. | 74/567 |
| 7,000,502 | B2 | * | 2/2006 | Belik | 81/57.2 |
| 7,017,450 | B2 | * | 3/2006 | Bangert | 81/57.33 |
| 7,090,254 | B1 | * | 8/2006 | Pietras et al. | 285/18 |
| 2003/0164071 | A1 | * | 9/2003 | Moe et al. | 81/57.2 |
| 2005/0076744 | A1 | * | 4/2005 | Pietras et al. | 81/57.16 |
| 2006/0027047 | A1 | * | 2/2006 | Buck | 81/57.18 |

OTHER PUBLICATIONS

Compact Iron Roughneck—IR30 SP, National Oilwell, www.natioil.com/customer.service@natoil.com.
IR-66 Iron Roughneck, Drilling Automatic, Inc.

* cited by examiner

*Primary Examiner* — Robert Scruggs
(74) *Attorney, Agent, or Firm* — Egbert Law Office, PLLC

(57) ABSTRACT

A tubular makeup and breakout assembly 10 includes a top spinner 20, an intermediate power tong 12 and a lower backup tong 14. The spinner comprises a frame 22 which houses a pair of hydraulic cylinders 24. A plurality of rollers 26 are each intended for frictional engagement with an outer surface of a tubular to rotate the tubular. Each roller 26 is powered by hydraulic drive motor 28. The roller receives a suitable drive shaft rotatably powered by the motor and having a polygonal cross-sectional configuration. The roller comprises segments which may be removed without removing the motor or the drive shaft.

16 Claims, 8 Drawing Sheets

SPINNER ASSEMBLY FOR OILFIELD TUBULAR CONNECTIONS

FIELD OF THE INVENTION

The present invention relates to equipment and techniques for threading and unthreading oilfield tubular members, such as drill pipe, which are run into and out of a well. More particularly, the invention relates to a spinner of a type used with a power tong and a backup tong supported on the floor of an oilfield rig.

BACKGROUND OF THE INVENTION

Various types of equipment have been devised for making up and breaking apart oilfield tubular members at a well site. U.S. Pat. No. 4,005,621 discloses a power tong for rotating tubular members. The power tong includes three circumferentially spaced jaws. A closed power tong with a plurality of jaws as disclosed in U.S. Pat. No. 5,000,065. In other applications, a spinner tool having a plurality of rollers is used for engaging a tubular member to rotate the tubular member, with high torque for final making up and breaking apart the threaded connection being provided by other equipment. U.S. Pat. No. 4,446,761 discloses a spinner assembly for rotating oilfield tubular goods.

U.S. Pat. No. 3,799,009 discloses an assembly comprising a spinner, a tong for making up or breaking apart the connection, and a backup tong for securing the lower pipe in position. U.S. Pat. No. 5,054,500 discloses a spinner assembly with toothed belts for driving rollers.

U.S. Pat. No. 5,791,206 discloses a breakout wrench for making and breaking joints between successive lengths of drill pipe. More particularly, circumferentially spaced dies engage the drill pipe.

One type of assembly including an upper spinner, an intermediate power tong for making up and breaking apart the threaded connection, and a lower tong is referred to as an "iron roughneck." U.S. Pat. No. 6,206,096 discloses an iron roughneck assembly, and more particularly a spinner with a plurality of rollers for rotating an upper tubular member. U.S. Pat. No. 6,253,845 discloses various embodiments for a roller of a spinner assembly.

The problems with the prior art equipment involved in threading and unthreading oilfield tubular members involve the high cost of manufacturing equipment, the complicated nature of the equipment which requires high maintenance, and the time and expense associated with replacing worn rollers in the spinner assembly.

The disadvantages of the prior art are overcome by the present invention, and an improved spinner assembly is hereinafter disclosed for threading and unthreading oilfield tubular connections.

SUMMARY OF THE INVENTION

In one embodiment, a spinner assembly is provided for threading and unthreading substantially vertical oilfield tubular goods at the location above rig floor at a well site. The spinner assembly includes:

a spinner housing;

a pair of substantially coaxial opposing brackets supporting the rollers and motors moving into and out of the spinner housing at the opposite direction;

an actuator linearly moving one or both brackets with rollers in the direction substantially coaxial with the spinner housing's common axis into or out of the spinner housing;

a plurality of rotatable rollers each having a central polygonal passageway for directly mating a driving shaft;

a plurality of driving shafts, portion of each shaft having an elongated polygonal shape in cross section for mating each roller through the entire depth of central polygonal passageway therein;

a plurality of fasteners each extending between and interconnecting the two or more axially spaced cylindrical portions, wherein each roller can be removed from the spinner assembly by removing only a plurality of fasteners, without removing any other component except the roller's each accurate member itself.

Each roller has a polygonal configuration for mating with a drive member rotatable by a respective motor. Each roller may have two or more axially spaced cylindrical portions, with a lower end of an upper cylindrical portion engaging an upper end of a lower cylindrical portion. Each cylindrical portion may have a plurality of arcuate members each having a generally semi-cylindrical exterior surface and end surfaces spaced adjacent ends of a respective exterior surface. The end surfaces of the arcuate members are in planar engagement, and the end surfaces of the upper cylindrical portion are circumferentially offset from the end surfaces of a lower cylindrical portion. A plurality of fasteners each extends axially between the two or more axially spaced portions, and interconnect the two or more cylindrical portions.

In another embodiment, the spinner assembly includes a pair of substantially coaxial opposing actuators physically separated, driving a pair of brackets into and out of the spinner housing at the opposite direction but substantially coaxial with the spinner housing's common axis passing through a central axis of the tubular member. A mounting bracket is provided for supporting a pair of rollers and a corresponding pair of motors. The mounting bracket may be preferably pivotally connected to each actuator, thereby obtaining contact between each of the pair of rollers and the tubular members in case a misalignment occurs.

In another embodiment, a coreless roller is provided for a spinner assembly to thread and unthread oilfield tubular goods or members at a well site. The roller includes two or more axially spaced cylindrical portions, with a lower surface of an upper cylindrical portion engaging an upper surface of a lower cylindrical portion. Each cylindrical portion has a plurality of arcuate members each having a generally semi-cylindrical exterior surface and end surfaces spaced adjacent ends of a respective exterior surface. The end surfaces of the first and second arcuate members are substantially in planar engagement, and the end surfaces of the upper cylindrical portion are circumferentially offset from the end surfaces of the lower cylindrical portion. A plurality of fasteners each extends axially between the two or more axially spaced portions and interconnect the cylindrical portions to form a complete roller without the need for a central support shaft or core.

These and further features and advantages of the present invention will become apparent from the following detailed description, wherein reference is made to the figures in the accompanying drawings.

DESCRIPTION OF THE PREFERRED EMBODIMENTS

Figure 1:
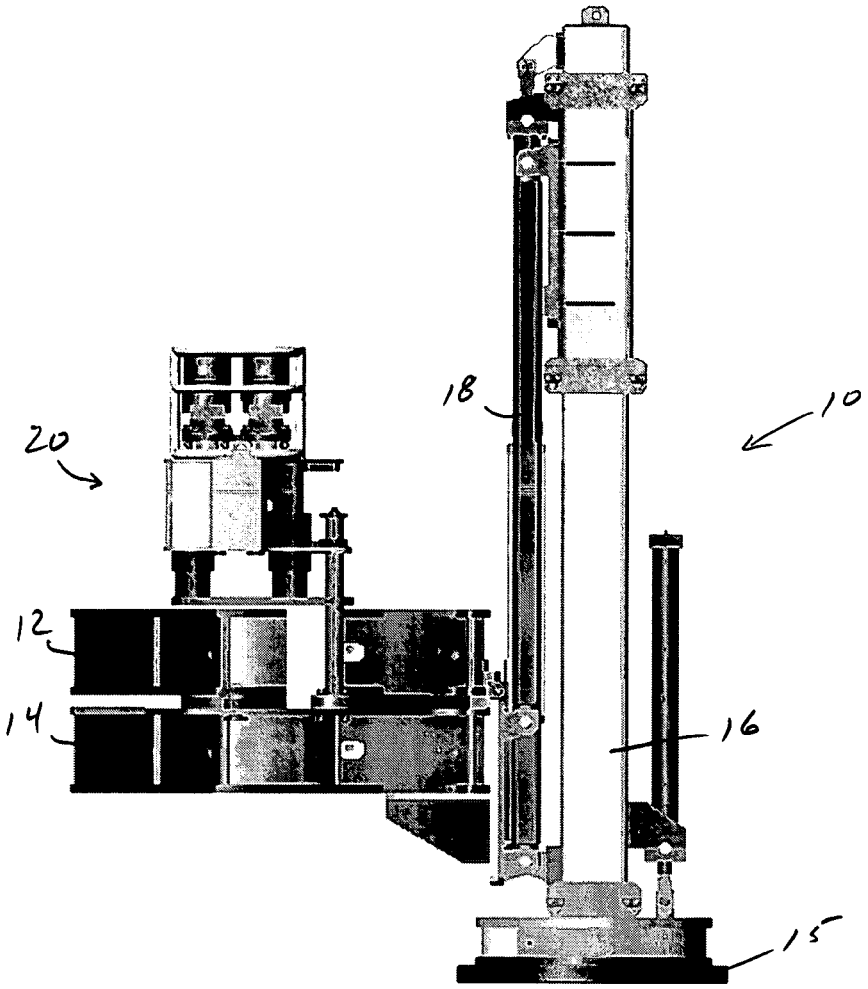
FIG. 1 is a simplistic side view of equipment according to the present invention for making up and breaking apart oilfield tubular connections.

FIG. 1 illustrates a tubular makeup and breakout assembly 10 for positioning on a rig floor at a well site. Those skilled in the art will appreciate that a substantially vertical oilfield tubular string comprising threaded joints or members may be received within a top spinner 20, an intermediate power tong 12 for final makeup and breakout of the threads, and a lower backup tong 14. Base 15, vertical post 16, and linkage arms 18 support the spinner and tongs, and allow both lateral and axial (vertical) movement with respect to the rig floor.

Figure 2:
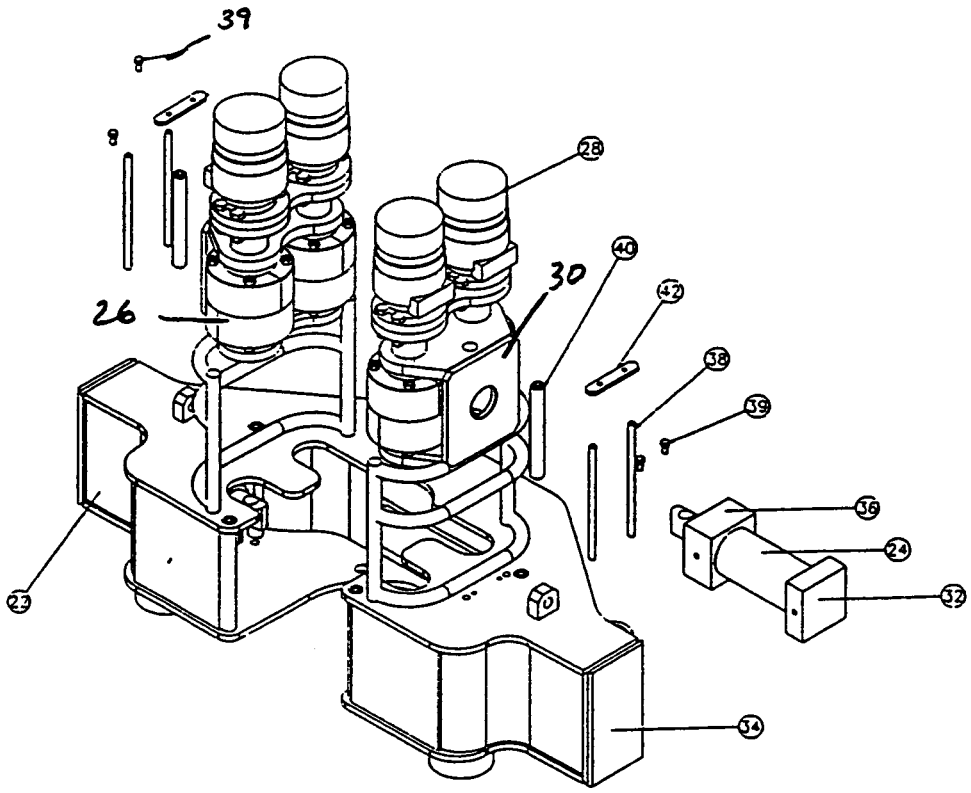
FIG. 2 is an exploded view of the spinner generally shown in FIG. 1.

Referring now to FIG. 2, the spinner 20 generally shown in FIG. 1 is illustrated in greater detail. The spinner comprises a spinner housing 22 which substantially houses a pair of hydraulic cylinders 24, with each hydraulic cylinder axis being substantially aligned and passing through a central axis of the tubular. FIG. 2 also illustrates a plurality of rollers 26 each intended for frictional engagement with an outer surface of the tubular to rotate or spin the tubular. Each roller 26 is powered by a hydraulic drive motor 28, which as shown in FIG. 2 is positioned above the roller and is supported on a bracket 30.

Rearward surface 32 of each cylinder 24 engages an end plate 34 of the spinner housing 22. A radially inward cylinder block 36 retains the cylinder at a fixed location within the spinner housing 22 by engagement with a pair of pins 38, which may be easily removed through a top or bottom surface of the spinner housing 22 to replace the cylinder, if necessary. Plate 42 may be provided on the exterior surface of spinner housing 22 to cover the pins 38, and also has holes to receive fasteners 39. A pin 40 interconnects the cylinder rod 25 with the bracket 30 (see FIG. 4), such that the bracket may rotate relative to the axis of the cylinder.

Figure 3:
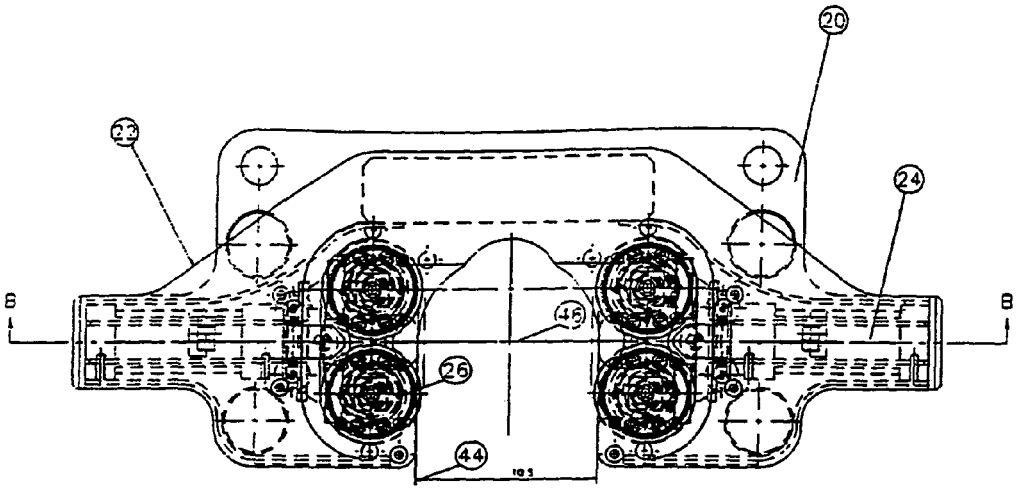
FIG. 3 is a top view of the spinner shown in FIG. 1.
Figure 4:
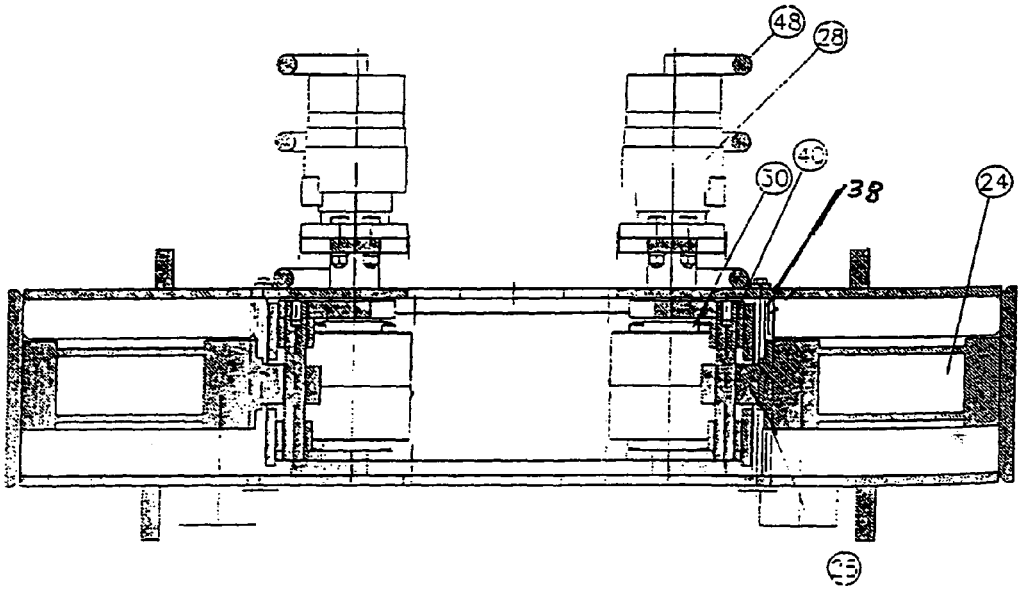
FIG. 4 is a side view of the spinner shown in FIG. 1.

FIG. 3 is a top view of a spinner 20 shown in FIG. 2, illustrating the open throat 44 in the spinner housing 22 for receiving a tubular member therein. Actuation of the cylinders 24 moves the rollers 26 inward along common axis 46 to engage the tubular. FIG. 4 illustrates the frame 48 for protecting the motors 28, and further illustrates the pivotal connection of the frame 30 provided by the pin 40 at the rod end of each cylinder 24.

Figure 5:
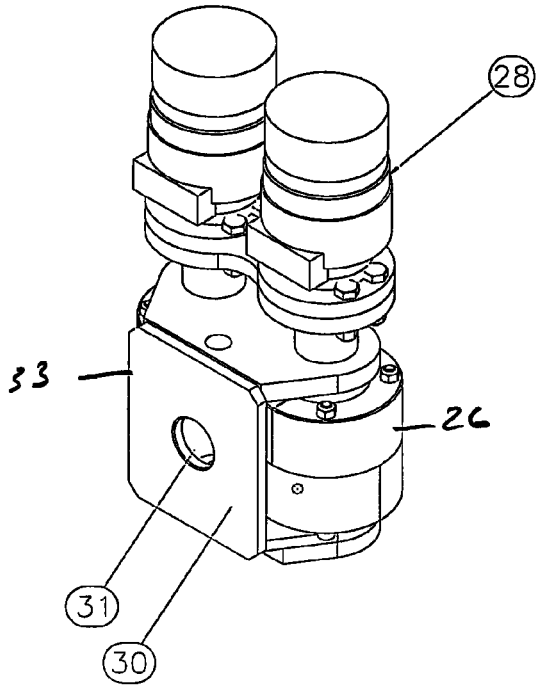
FIG. 5 is a pictorial view of a bracket supporting a pair of rollers and a pair of motors.

FIG. 5 illustrates in greater detail two motors 28, each for powering a respective roller 26, and the bracket 30 for supporting both the rollers and the motors. Bracket 30 includes a hole 31 in the radially outward plate 33 for receiving the rod end of a cylinder, and allows pivoting movement of the bracket 30 with respect to the axis of the cylinder 24.

Figure 6:
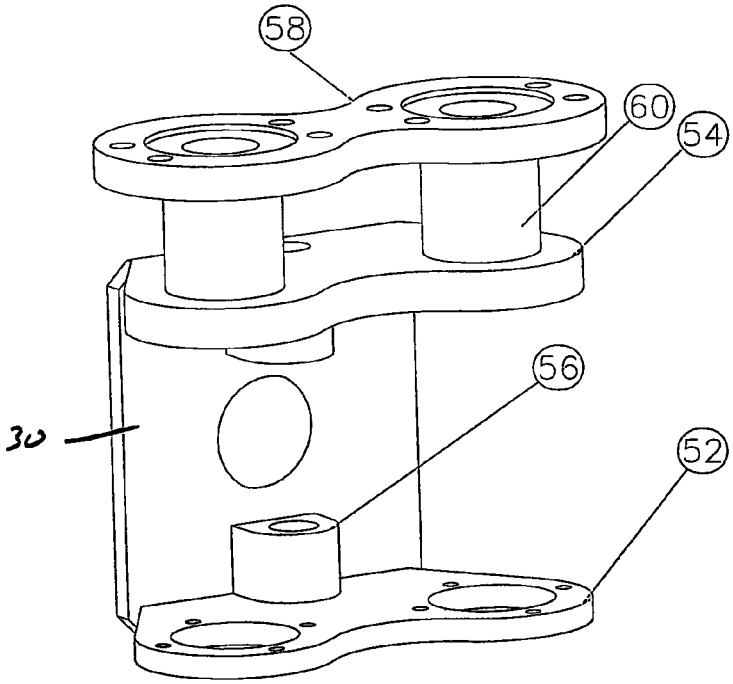
FIG. 6 is a pictorial view of the bracket generally shown in FIG. 5.

FIG. 6 illustrates in greater detail suitable configuration for the bracket 30, with a lower plate 52 having a pair of apertures each for receiving a respective roller bearing assembly, and a similar cavity in the plate 54 housing an upper bearing assembly. A pair of end blocks 56 are provided for rotatably supporting the rod 40, which may be slid into position through a suitable hole in plate 54. Upper plate 58 is supported on a pair of hollow posts 60, which houses the drive shafts 62 interconnecting each motor with a respective roller. A pair of driving motors are mounted on the top plate 58 as shown in FIG. 5.

Figure 7:
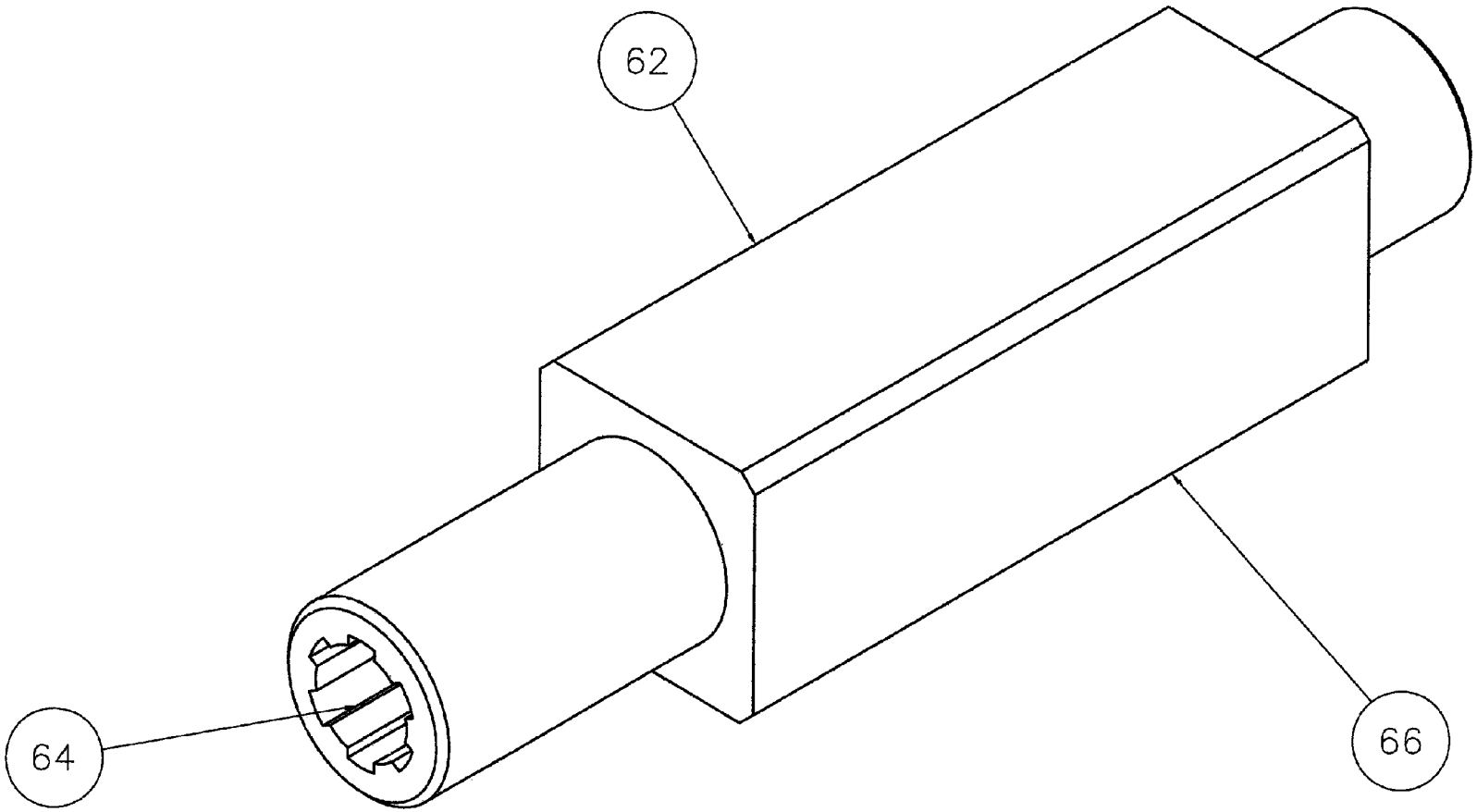
FIG. 7 is a pictorial view of a drive shaft rotatable by a motor for rotating a respective roller.

FIG. 7 shows a suitable drive shaft 62 having a splined end 64 coupled to the splined output shaft of a motor, and an elongated portion 66 with polygonal shape in cross section. As explained subsequently, it is a feature of the invention that the roller has a center passageway with at least a portion having polygonal cross-sectional configuration for receiving an elongate polygonal portion of a drive shaft driven by a motor. Although a shaft with a square cross-section is depicted, the shaft and the mating passageway in the roller could have a hexagonal or octagonal cross-sectional configuration. In a preferred embodiment, the polygonal configuration of the drive shaft extends at least substantially through the length of the passageway through the roller.

Figure 8A:
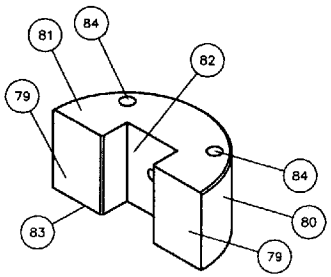
FIGS. 8A, 8B, 8C, 8D are the pictorial views of a preferred embodiment of spinner roller configuration.

FIG. 8A illustrates the configuration of a preferred embodiment of an arcuate member. In a preferred embodiment, each arcuate member has a generally semi-cylinderical exterior surface 80 which may be grooved or otherwise profiled for increasing frictional engagement with a tubular, end surfaces 79 spaced adjacent ends of a respective exterior surface 80, a upper surface 81, a lower surface 83, a portion of rectangular central passageway 82 extending all the way through the arcuate member, and a plurality of holes 84 for suitable securing members 85 connections. The material of an arcuate member can be metatic or non-metatic.

Figure 8C:
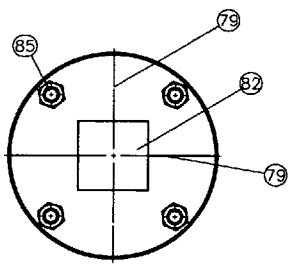
Figure 8B:
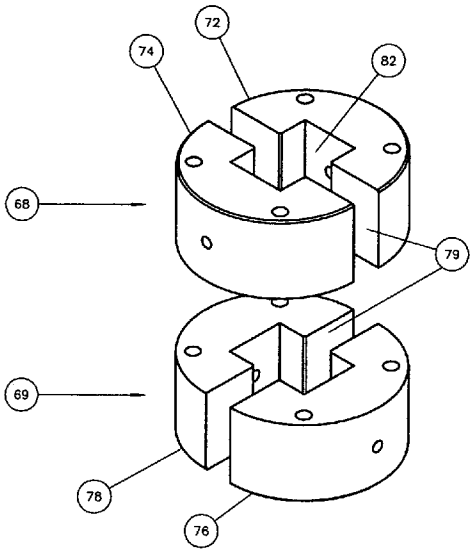

FIG. 8B illustrates a disassembled roller 26 composed of arcuate members 72 and 74 forming an upper cylindrical portion 68, and arcuate members 76 and 78 forming a lower cylindrical portion 69 of the roller 26.

In a preferred embodiment, each of the arcuate members 72, 74, 76 and 78 is identical in structure as shown in FIG. 8A, thereby significantly reducing manufacturing costs.

Figure 8D:
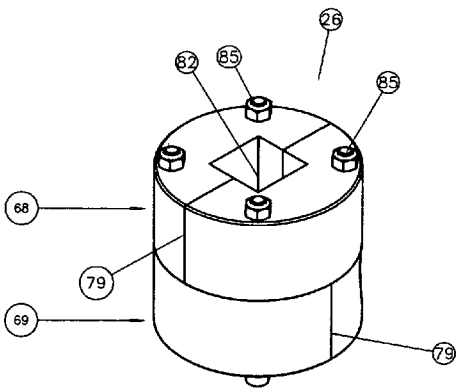

FIGS. 8C and 8D illustrate an assembled roller 26 having an upper cylindrical portion 68, an lower cylindrical portion 69 with a lower end of an upper cylindrical portion 68 engaging an upper end of a lower cylindrical portion 69, a central passageway 82 extending through the roller 26 for receiving the polygonal block 66 of the drive shaft 62, and a plurality of fasteners 85. The end surfaces 79 of the upper cylindrical portion 68 are circumferentially offset approximately 90 degrees from the end surfaces 79 of the lower cylindrical portion 69 to substantially align the central passageway 82 both through the upper cylindrical portion 68 and the lower cylindrical portion 69 for receiving the drive shaft block 66, and also to substantially align the fastening holes 84 for the fasteners 85 to run through the upper cylindrical portion 68 and the lower cylindrical portion 69 such that all arcuate members are substantially interconnected each other by the fasteners 85.

During the replacement of the worn rollers, the only parts to be removed are the fasteners 85 that hold the arcuate members together and one or all of the arcuate members can be taken off the drive shaft 62 without removing the motor 28 or the drive shaft 62.

Figure 9A:
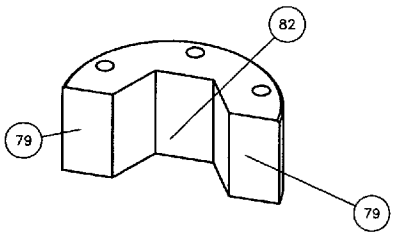
FIGS. 9A, 9B, 9C, 9D are the pictorial views of another embodiment of spinner roller configuration.
Figure 9C:
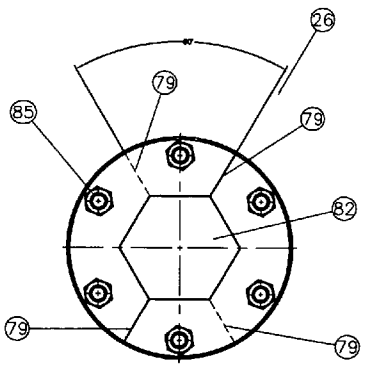
Figure 9B:
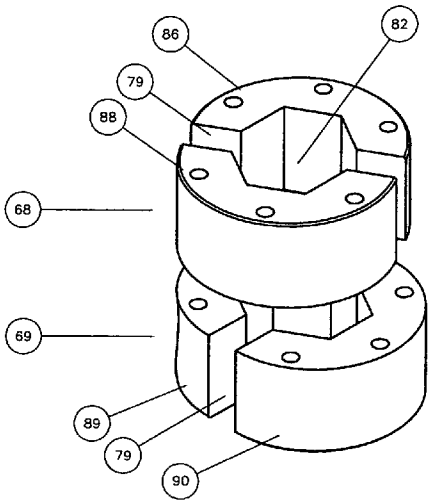
Figure 9D:
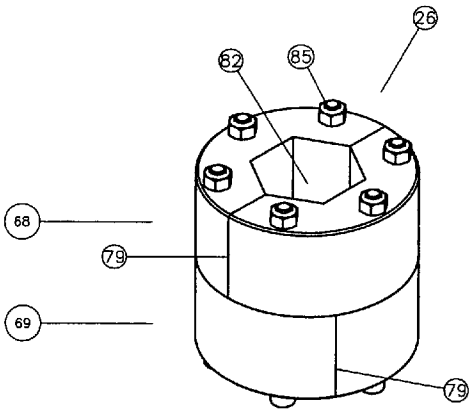

FIGS. 9A, 9B, 9C, 9C illustrate another embodiment of a roller 26 composed of arcuate members 86 and 88 forming a upper cylindrical portion 68, and arcuate members 89, 90 forming a lower cylindrical portion 69. Each arcuate member again is preferable identical in structure as shown in FIG. 9A. The roller 26 in this embodiment as shown in FIGS. 9C, 9D differs from the embodiment of roller 26 in FIGS. 8C, 8D in that the passageway 82 extending through the roller 26 in this embodiment has substantially a hexagonal cross sectional configuration. The engaged end surfaces 79 of the arcuate members in the upper cylindrical portion 68 are circumferentially offset approximately 60 degrees from the engaged end surfaces 79 of the arcuate members in the lower cylindrical portion 69. Accordingly, The portion of drive shaft 62 engaging with the passageway 82 in this embodiment will also have a substantially hexagonal cross-sectional configuration.

Figure 10A:
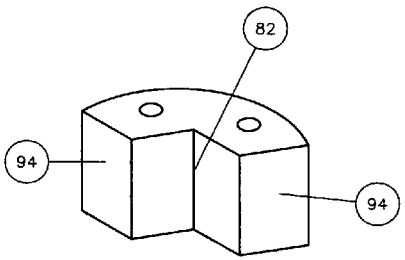
FIGS. 10A, 10B, 10C, 10D are the pictorial views of another embodiment of spinner roller configuration.
Figure 10C:
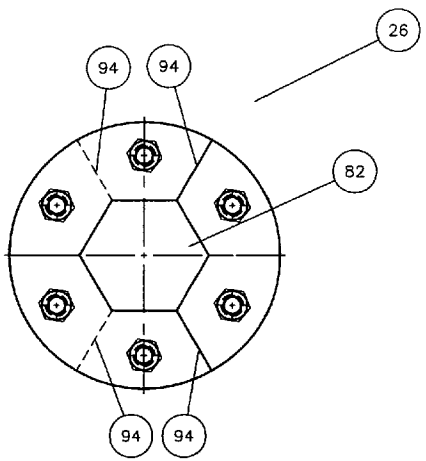
Figure 10B:
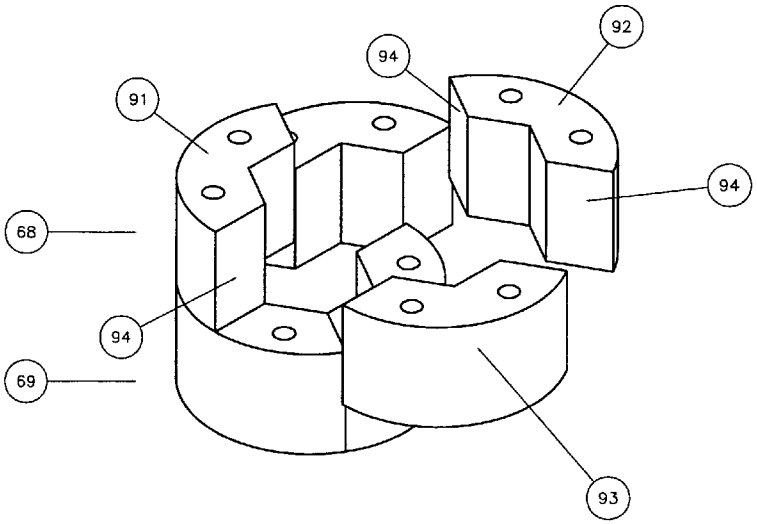
Figure 10D:
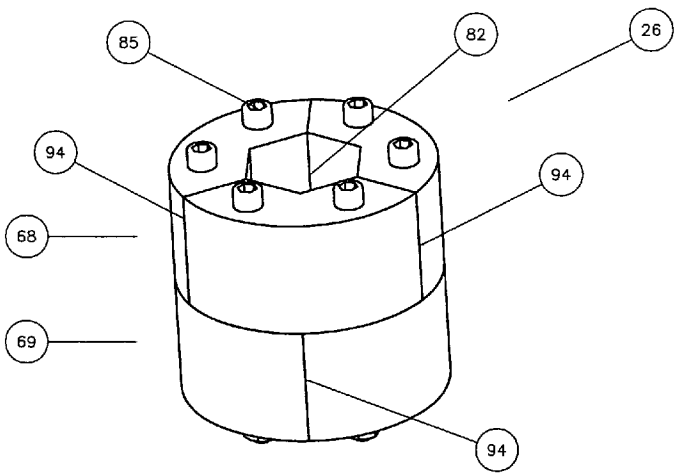

FIGS. 10A, 10B, 10C, 10D illustrate yet another embodiment of a roller 26 wherein each upper and the lower cylindrical portion 68, 69 is comprised of three arcuate members as shown in FIG. 10A. As with the other embodiments, the arcuate members are identical in structure and have an outer surface for frictional engagement with a tubular. A hexagonal shaped passageway 82 is extending all the way through the roller 26, and six bolts passing through an underside of the lower arcuate members and through an aligned bolt hole in the upper arcuate members may be used in conjunction with six nuts to hold the assembly together. For this embodiment, the offset angle of the engaged end surfaces 94 between the upper and the lower cylindrical portion 68, 69 would be approximately 60 degrees.

Those skilled in the art will appreciate that each roller may be formed from two or more axially stacked cylindrical portions, with each cylinder portion formed from a pair of arcuate members with end surfaces positioned along a plane that passes substantially through the axis of the roller. A thin pad or spacer could be provided between these cylindrical portions to prevent their engagement, with a lower end of the upper cylindrical portion then spaced slightly above the upper end of a lower cylindrical portion.

The pair of arcuate members which form each cylindrical portion preferably have end surfaces in planar engagement, although the end surfaces could be spaced slightly from each other. The end surfaces of the cylindrical portions are circumferentially offset for an assembled roller, such that a plurality of bolts or other securing members may extend between and interconnect the axially spaced cylindrical portions. Each fastener may be removed from a respective roller through the bottom of the roller, such that the fastener is removed in a direction opposite the motor with respect to the roller.

The embodiment disclosed herein utilizes four rollers and a motor for powering each roller. In other embodiments, additional rollers may be provided, with at least two rollers being powered for rotating the tubular, and at least two other rollers for engaging and stabilizing the rotating tubular. In other embodiments, a motor to be provided at each end of the drive shaft, so that two motors powered a single roller. Other combinations may include some rollers powered by two motors, and other motors powered by a single roller.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A spinner assembly for threading or unthreading substantially vertical oilfield tubular members above a floor at a well site, comprising:

a spinner housing having an open throat for receiving a tubular member therein, said spinner housing having a common axis;

a plurality of rollers rotatable about a substantially vertical axis and adapted to engage said tubular member positioned within said throat;

a plurality of motors for rotating the rollers;

a plurality of driving shafts, each driving shaft being connected to one of said plurality of motors and having an elongated portion of polygonal shape in cross section, a pair of substantially coaxial, opposing brackets supporting the rollers and motors and disposed within said spinner housing on opposite sides of said throat, said brackets being movable within said spinner housing in a direction towards and away from said throat, wherein said brackets and rollers move in and out of the spinner housing in opposite directions in a substantially straight line along said common axis;

a pair of actuators disposed within said spinner housing on opposite sides of said throat, each actuator including a first end connected to said spinner housing and a second end attached to one of said brackets for moving said brackets and rollers along said common axis;

each of said plurality of rotatable rollers having a central polygonal passageway for directly mating with one of said driving shafts;

each roller having two or more axially spaced cylindrical portions, a lower surface of an upper cylindrical portion spaced above an upper surface of a lower cylindrical portion;

each cylindrical portion having a plurality of arcuate members each having a partially cylindrical exterior surface and end surfaces spaced adjacent ends of a respective exterior surface, each end surface of each arcuate member being in planar engagement with an end surface of an adjoining arcuate member, and the end surfaces of the upper cylindrical portion being circumferentially offset from the end surfaces of the adjoining lower cylindrical portion; and each roller having a plurality of fasteners each extending between and interconnecting the two or more axially spaced cylindrical portions, wherein each arcuate member can be removed from the spinner assembly by removing only a plurality of fasteners, without removing any other component except the roller's each arcuate member itself.

2. A spinner as defined in claim 1, wherein the plurality of rollers each driven by a motor comprise four circumferentially spaced rollers each in engagement with the tubular member when rotating the tubular member.

3. A spinner as defined in claim 1, wherein an actuator comprises a hydraulic cylinder.

4. A spinner as defined in claim 1, wherein the central polygonal passageway is one of a rectangular shape, hexagonal shape, or an octagonal shape in cross section.

5. A spinner assembly as defined in claim 1, wherein the plurality of fasteners includes at least four fasteners.

6. A spinner assembly as defined in claim 1, wherein each of the plurality of fasteners is removable from a respective roller in a direction opposite the motor with respect to a respective roller.

7. A spinner assembly as defined in claim 1, wherein the number of motors is equal to the number of rollers and wherein the length of each driving shaft is at least as long as the length of the central polygonal passageways in the rollers so that each driving shaft engages a respective central polygonal passageway through the entire depth of the passageway.

8. A spinner assembly as defined in claim 1, wherein each of the rollers is a coreless roller, wherein each arcuate member within the entire roller is interconnected to each other by said fasteners to form a complete roller without a central support member.

9. A coreless roller for a spinner assembly to thread and unthread oilfield tubular members at a well site, comprising:

two or more axially spaced cylindrical portions, a lower surface of an upper cylindrical portion spaced above an upper surface of a lower cylindrical portion;

each cylindrical portion having a central polygonal passageway for directly mating with a driving shaft and holes for running through fasteners in the upper and lower cylindrical portions;

each cylindrical portion having a plurality of arcuate members each having a partially cylindrical exterior surface and end surfaces spaced adjacent ends of a respective exterior surface, the end surface of each arcuate member being in planar engagement with an end surface of an adjoining arcuate member;

the end surfaces of the upper cylindrical portion being circumferentially offset from the end surfaces of the adjoining lower cylindrical portion to align the central polygonal passageways and the holes for running through the fasteners in the upper and lower cylindrical portions; and a plurality of fasteners each extending axially between the two or more axially spaced portions, wherein each arcuate member within the entire roller is interconnected to each other to form a complete roller without a central support member.

10. A coreless roller as defined in claim 9, wherein the polygonal passageway of each cylindrical portion is one of a rectangular shape, hexagonal shape, or an octagonal shape in cross section.

11. A coreless roller as defined in claim 9, wherein the plurality of securing members includes at least four fasteners.

12. A coreless roller as defined in claim 9, wherein each of the plurality of fasteners is removable from a respective roller in a direction opposite a roller motor with respect to the roller.

13. A coreless roller as defined in claim 9, wherein each of the cylindrical portions comprises at least two arcuate members.

14. A coreless roller as defined in claim 9, wherein a thin pad is provided between the lower surface of the upper cylindrical portion and the upper surface of the lower cylindrical portion.

15. A spinner assembly for threading or unthreading substantially vertical oilfield tubular members above a floor at a well site, comprising:

a spinner housing having an open throat for receiving a tubular member therein, said spinner housing having a common axis;

a plurality of rollers rotatable about a substantially vertical axis and adapted to engage said tubular member positioned within said throat;

a plurality of motors for rotating the rollers;

a plurality of driving shafts, each driving shaft being connected to one of said plurality of motors and having an elongated portion of polygonal shape in cross section;

a pair of brackets supporting the rollers and motors and disposed within said spinner housing on opposite sides of said throat, said brackets being movable within said spinner housing in a direction towards and away from said throat, wherein the said brackets in the pair move in and out of the spinner housing in opposite directions in a substantially straight line along said common axis.

16. A spinner assembly as defined in claim 15, further comprising a pair of actuators disposed within said spinner housing on opposite sides of said throat, each actuator including a first end connected to said spinner housing and a second end attached to one of said brackets for moving said brackets in said substantially straight line.

* * * * *